United States Patent [19]

Ford

[11] 4,093,326

[45] June 6, 1978

[54] ARTIST'S KIT

[76] Inventor: Thomas Edward Ford, 150-24 6th Ave., Whitestone, N.Y. 11354

[21] Appl. No.: 685,438

[22] Filed: May 11, 1976

[51] Int. Cl.[2] ..... A47B 97/04

[52] U.S. Cl. ..... 312/231; 248/461

[58] Field of Search ..... 312/231, 230; 297/252; 248/461, 449, 500

[56] References Cited

U.S. PATENT DOCUMENTS

| | | | |
|---|---|---|---|
| 815,810 | 3/1906 | Goldsworthy | 312/231 |
| 2,142,317 | 1/1939 | Jarrett | 248/449 |
| 2,586,524 | 2/1952 | Dussardier | 312/231 |
| 2,729,018 | 1/1956 | Morgan | 248/461 |
| 2,751,271 | 6/1956 | Dessertenne et al. | 312/231 |
| 2,792,875 | 5/1957 | Pirrone | 297/252 |
| 3,132,439 | 5/1964 | McGill | 312/231 |
| 3,168,363 | 2/1965 | Monsour | 248/461 |
| 3,202,471 | 8/1965 | Wilson | 248/461 |
| 3,540,787 | 11/1970 | Ford | 312/231 |
| 3,669,227 | 6/1972 | Alford | 312/231 |

FOREIGN PATENT DOCUMENTS

| | | | |
|---|---|---|---|
| 87,537 | 1921 | Austria | 312/231 |
| 1,363,532 | 5/1964 | France | 248/461 |

*Primary Examiner*—Paul R. Gilliam
*Assistant Examiner*—Victor N. Sakran

[57] ABSTRACT

An artist's kit comprising a box and a pivotally mounted cover. The box can be secured to a mounting surface by use of mounting members to provide a stable support for the kit when in use. The cover is capable of being secured in a plurality of open positions and a head clamp and bottom support releasably mount the canvas to the cover during use. The head clamp and bottom support may be reversely mounted for transporting the canvas.

12 Claims, 13 Drawing Figures

FIG. 6A
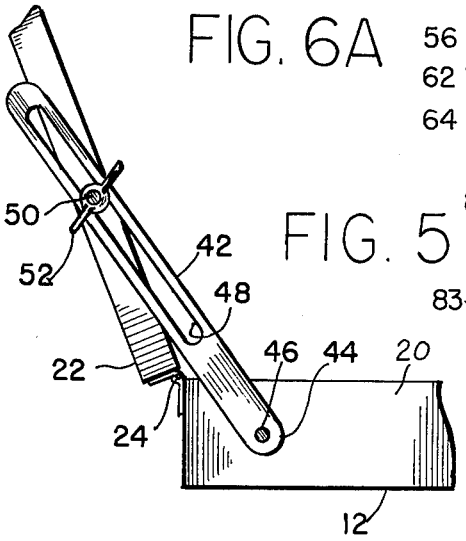
FIG. 5
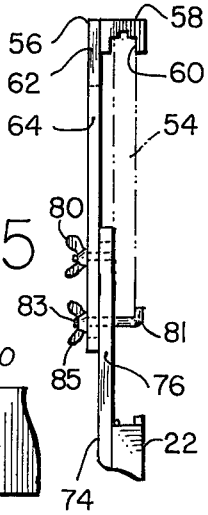
FIG. 6
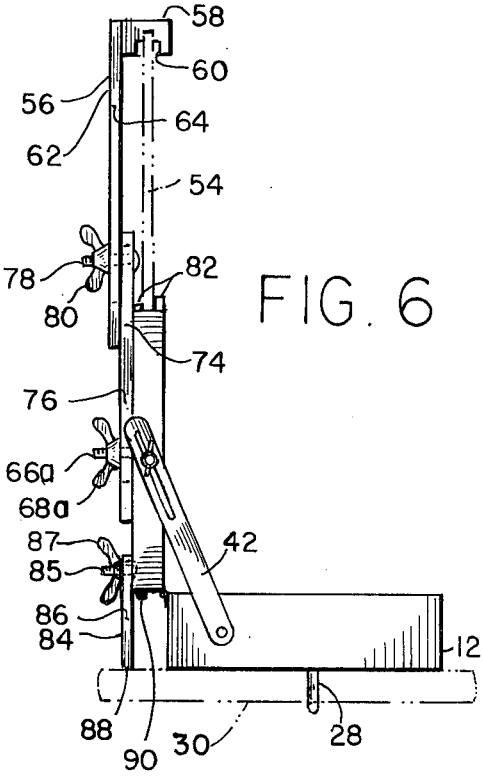
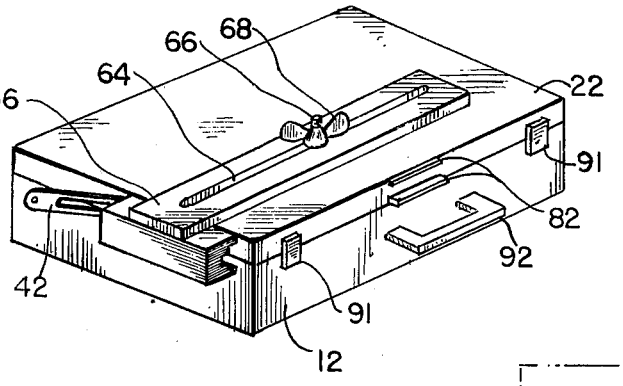
FIG. 9
FIG. 7
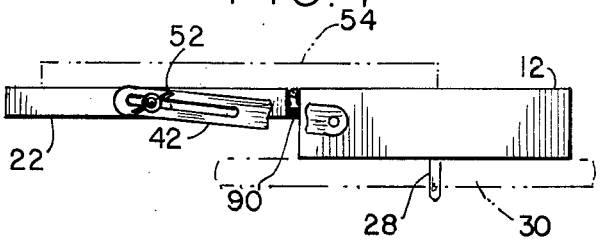
FIG. 10
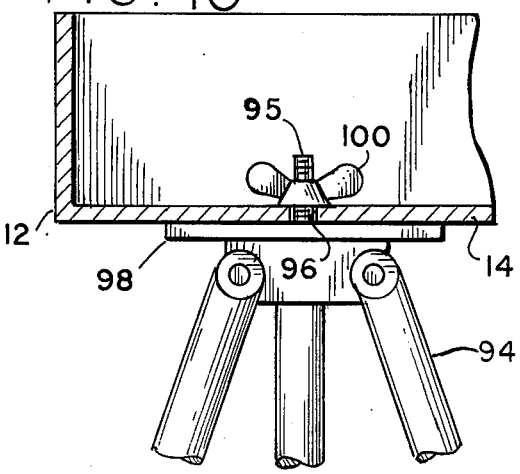
FIG. 8
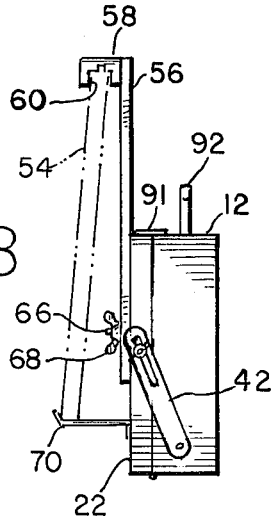

ARTIST'S KIT

BACKGROUND OF THE INVENTION

The present invention relates to artist's kits and particularly to a portable device which may be used in a classroom, studio or in the outdoors for holding the artist's materials, serve as an easel for the canvas and be securely mounted to a convenient surface such as the top of a table, a stool or the like allowing the artist to paint upon a canvas that could not slide or otherwise move during use.

Portable artist's kits are known in the art, but these devices have no means provided for securely retaining the kit to an external support. Some do have built-in supporting legs that are cumbersome to use and require that this extra weight be carried by the artist. Examples of prior art devices that have incorporated integral leg members as the only means of support include U.S. Pat. Nos. 654,841, 3,132,439, 3,168,363, 3,202,471 and 3,540,787, French Pat. 1,450,682 and Swedish Pat No. 304,097.

SUMMARY OF THE INVENTION

It is the principle object of this invention to provide a portable artist's kit that may be releasably clamped to a table, stool or other mounting surface during use to provide a rigid and stable support.

A further object is to provide an easel that can releasably mount a canvas or other workpiece for painting.

A still further object is to provide means to position the canvas at a height and at an angle with respect to the mounting surface as preferred by the artist.

A still further object is to provide a method of transporting a wet canvas so the painted surface is protected from smearing or being otherwise damaged.

A still further object is to provide a low cost and lightweight kit capable of storing therein all the mounting and easel accessories in addition to the paints, brushes, etc.

These and other objects are achieved by the preferred embodiment of the present invention which comprises a shallow rectangular box having a hinged cover. Two or more holes or slots are located in the base of the box. A pair of "L" shaped mounting members are incorporated to clamp the box to a mounting surface. One leg of each clamping member is positioned beneath the mounting surface while each of the other legs are disposed through one of the holes or slots in the base. The end of the leg extending through the hole is threaded to engage a wing nut for biasing the box against the mounting surface.

An easel, disposed in the cover, supports the canvas. The canvas is gripped on the top by a top clamp that is slidably mounted in cover. One or more supports for the bottom of the canvas are mounted through a series of holes in the cover. By this means, the canvas is securely clamped and can be positioned at an preferred distance above the ground when the box is clamped as previously described. The cover can be held in any of a plurality of open positions by an elongated arm pivotally mounted at one end to the side of the box and slidably mounted to the cover. The cover could be locked in a position so the canvas or other work surface either tilts forward with its top closest to the artist, or disposed approximately vertically or finally with the surface to be painted upon disposed in a horizontal position. The first of these positions is preferable when using pastels, charcoal or other chalk-like mediums since the dust that is abraided off during use could fall vertically and not recontact the work surface. Oils are generally used with the canvas near the vertical and watercolors are best applied with a horizontally positioned work surface so the thin paint cannot run on the surface.

Having in mind the above and other objects that will be obvious from an understanding of the disclosure, the present invention comprises a combination and arrangement of parts illustrated to the presently preferred embodiments of the invention which are hereinafter set forth in sufficient detail to enable those persons skilled in the art to clearly understand the function, operation, construction and advantage of it when read in conjunction wih the accompanying drawings.

BRIEF DESCRIPTION OF THE DRAWINGS

The invention will be described in detail, by way of example, with reference to the accompanying drawings in which:

FIG. 5 is a partial side view of the kit;

FIG. 6 is a side view of the kit arranged to hold a canvas in a high position;

FIG. 6*a* is a side view of the kit arranged to hold a canvas in a high position;

FIG. 7 is a side view of the kit with the cover disposed horizontally;

FIG. 8 is a side view of the kit arranged for transporting a canvas;

FIG. 9 is a pictorial view of the kit in a closed position; and

FIG. 10 is a partial sectional view of the kit mounted to a tripod.

DETAILED DESCRIPTION OF THE INVENTION

Figure 1:
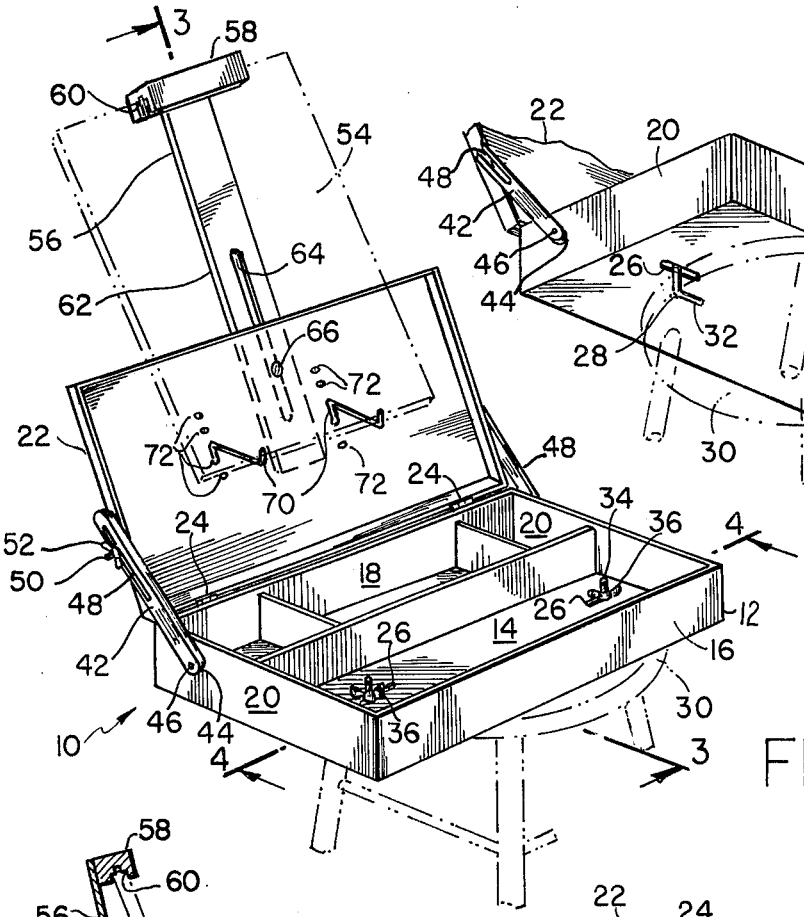
FIG. 1 is a pictorial view of the preferred embodiment of the invention.
Figure 2:
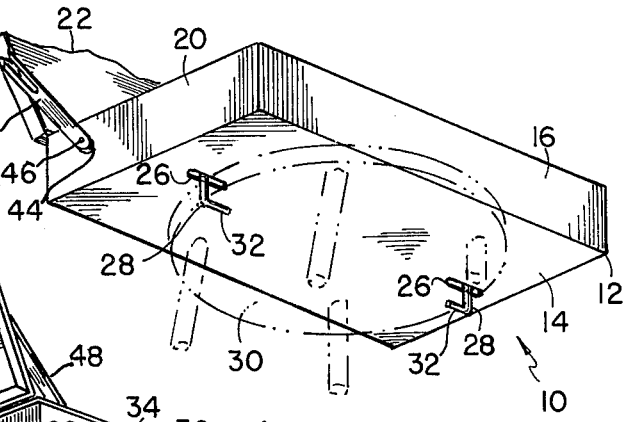
FIG. 2 is a pictorial view of the underside of the kit illustrating the clamping members.
Figure 3:
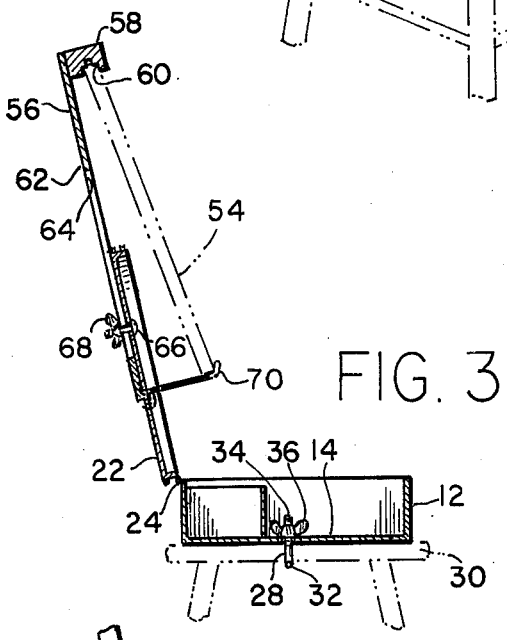
FIG. 3 is a side sectional view taken along line 3—3 in FIG. 1.
Figure 4:
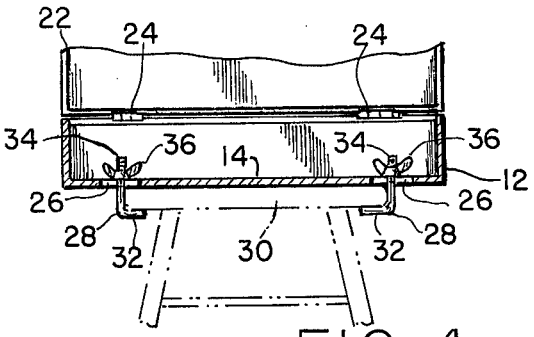
FIG. 4 is a front sectional view taken along line 4—4 in FIG. 1.

Referring to FIGS. 1 and 2 of the drawings and in accordance with the principles of the invention, an artist's kit 10 is shown comprising a rectangular box 12 having a base 14, a front wall 16, a rear wall 18 and side walls 20. A cover 22 is pivotally mounted to the rear wall 18 with hinges 24. Two or more apertures or slots 26 are located in the base 14 and a pair of mounting members 28 are used to clamp the box 12 to mounting surface 30. As shown in FIGS. 3 and 4 the mounting members 28 each have a first portion 32 that can be positioned beneath the mounting surface 30 and a threaded second portion 34 that is connected at right angles with the first portion 32. Each second portion 34 is threaded to engage a wing nut 36 that, upon rotation, will bias each second portion against the underside of the mounting surface 30 to effect clamping the base 14 to the mounting surface 30. Reversing the rotation of the wing nuts 36 releases the kit 10.

Figure 3A:
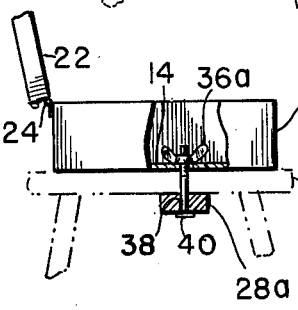
FIG. 3*a* is a side sectional view of an alternative embodiment.
Figure 4A:
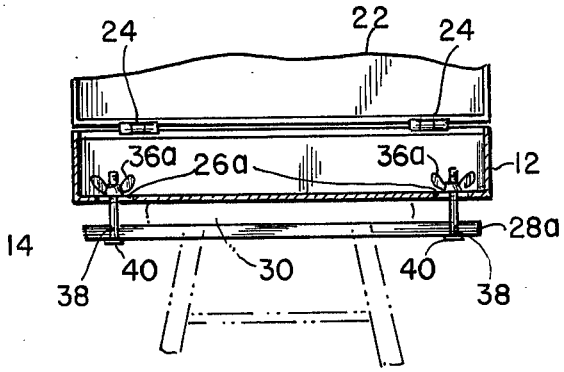
FIG. 4*a* is a front sectional of an alternative embodiment.

An alternative embodiment of the clamp is shown in FIGS. 3*a* and 4*a*. In this embodiment, two or more apertures or holes 26a are located in the base. Brace 28a, which has a pair of holes 38 positioned at the same center distance as holes 26a, engages the underside of the mounting surface 30. Two threaded bolts 40 pass through one of the holes 38 in the brace 28a and the corresponding hole 26a in the base 12. Wings nuts 36a similarly engage the threaded bolts to bias the brace 28a against the underside of mounting surface 30.

The cover 22 can be retained in any one of a plurality of open positions by means of at least one elongated arm 42. As shown in FIG. 5, the arm 42 is pivotally mounted at one end 44 to a side wall 20 of the box 12 by pin 46. A longitudinal slot 48 is located at the other end of the arm 42 and a threaded pin 50 affixed to an edge of the cover 22 passes through the slot 48 to effect the slidable mounting of said arm 42. Wing nut 52 engages the threaded pin 50 and upon rotation thereof, the sliding motion can be selectively prevented to fix the angular position between the box 12 and the cover 22 thereby retaining the cover in any one of a plurality of open positions.

The kit can serve as an easel for supporting a canvas 54 or other work surface. One arrangement for releasably mounting the canvas 54 is shown in FIGS. 1 and 3. A top clamp 56 has a first member 58 having one or more grooves 60 therein configured to grip canvases 54 having different widths. An elongated second member 62 is affixed to the first member and has an elongated slot 64 therein for slidable mounting to the outside of the cover 22. Locking means, comprising at least one threaded stud 66, affixed to the cover 22 and passing through slot 64 engages with a wing nut 68 to allow guiding, positioning, clamping and releasing of the canvas 54.

The bottom of the canvas 54 is retained by one or more bottom supports 70. These supports 70 can be formed of resilient steel rods and mounted to the cover 22 by means of one or more holes 72 therethrough similar to the manner in which commercial peg board brackets are anchored to the board. The flexibility of the rod 70 will serve to bias the canvas 54 against the top clamp 56. The supports 70 can be configured to grip the canvas 54 to prevent shifting. By making use of the arm 42 to position and lock the cover 22, the canvas 54 after being securely fastened adjacent to the inside surface of the cover 22 may be angularly positioned at the preference of the artist. Furthermore, several sets of mounting holes 72 can be located in the cover to allow the canvas 54 to be set at various heights with respect to the mounting surface 30. The top clamp 56, being slidably mounted would comply to the height of and secure the canvas 54 at these different heights.

In alternative embodiments shown in FIGS. 6 and 6A the canvas can be positioned yet higher by providing an elongated extension member 74 that would permit the top clamp 56 to slidably extend to a greater height. The elongated member 74 has a longitudinal slot 76 therethrough and is slidably mounted to the cover 22 with at least one threaded bolt 66a, engaging with a wing nut 68a in the same manner the second member 62 was mounted. The second member 62 now slidably mounts to extension member 74 utilizing at least threaded bolt 78 passing through the slots 64 and 76 in each member 62 and 74 and each bolt is retained by wing nut 80. The bottom of the canvas 54 is retained by cleats 82 located in the front edge of the cover 22. Alternatively, the bottom of the canvas 54 may be retained by an "L" shaped clamp 81 that has a threaded portion 83 passing through slots 64 and/or 76 in members 62 and 74 respectively. Wing nut 85 locks the clamp 81 against the canvas.

It would at times be necessary to provide additional support to the cover 22 when painting at a distance from the mounting surface. A leg member 84 having a slot 86 therethrough is similarly slidably mounted to the cover with threaded stud 85 passing through a hole in the cover 22 and engaging wing nut 87. One end 88 of the leg 84 could then be positioned to bear against the mounting surface 30 to provide the additional support.

The hinged connection 24 between the box 12 and the cover 22, and the elongated arm 42 permit the inside of the cover 22 to be positioned parallel to and in the same plane as the upper edges of the walls 16, 18 and 20 of the box 12. As shown in FIG. 7, the kit 10 when opened to this position allows the canvas 54 to lie flat. A rubber bumper 90 affixed to the inside of the cover provides an additional stop.

The painted canvas can be transported while still wet by mounting it to the outside of the cover 22 when the cover is in the closed position. As shown in FIG. 8, the top clamp 56 and bottom support 70 are assembled to the outside of the cover 22 by reversing these components. The canvas 54 is mounted as in the easel mode but with the painted surface spaced apart and facing the outside of the cover for protection against smearing.

FIG. 9 shows the kit 10 closed. The top clamp 56 is rotated to fit closely against the cover and is retained by stud 66 and wing nut 68 mounted through slot 64. The bottom support 70, mounting members 28 or brace 28a, the elongated member 74, the leg 84 and various hardware pieces can all be carried in the box 10. The cover 22 is latched to the box 12 by means of catches 91 and carrying handle 92 provides a carrying grip.

Another alternative embodiment is shown in FIG. 10. A commercial tripod 94 such as used by photographers can be utilized to support the kit 10. An aperture 96 is located in the base 14. The threaded mounted stud 95, generally included in the tripod for mounting a camera, projects vertically from the mounting plate 98 and passes through aperture 96. The kit is secured with a wing nut 100. If the particular tripod has too small a mounting plate to properly support the kit 10, an additional plate, not shown, could be added for a broader based support. The additional plate may have adapting threaded studs and screws to permit the accommodation of many types of commercial tripods available thereby permitting the utilization thereof as a support for the kit.

While the preferred and alternative embodiments of the invention are described, it will be understood that the invention is in no way limited by these embodiments.

What is claimed is:

1. An artist's kit comprising:

a. a rectangular box for holding artist's materials including a base and a front wall, a rear wall and side walls all vertically disposed with respect to said base, and further including a cover;

b. means mounting said cover to said box for pivotal movement between a closed position wherein said cover overlays the walls of said box and any one of a plurality of open positions; and c. means partly disposable within and without said box for releasably clamping said kit to an external mounting surface including means for biasing the base of said box against said mounting surface for effecting the clamping of said box to said mounting surface, wherein the releasable clamping means includes means defining at least two apertures in said bias, a pair of mounting members each having a first portion positionable beneath the mounting surface and a second portion connected to said first portion and extendable through one of said apertures and wherein said biasing means is disposable within said box for acting on each of said second portions for biasing each first portion against the underside of the mounting surface.

2. The artist's kit as recited in claim 1, wherein said second portion of each mounting member includes a threaded section and said biasing means comprises a pair of threaded wing nuts each engageable with the threaded section of one of said second portions.

3. The artist's kit as recited in claim 1, further comprising means for releasably retaining said cover in any one of said plurality of open positions.

4. The artist's kit as recited in claim 3, wherein said means for releasably retaining said cover comprises at least one elongated arm, means pivotally mounting one end portion of said arm to one of said side walls, means defining a longitudinal slot in said arm, and means for slidably mounting said arm to said cover including a locking member for releasably clamping said arm to said cover to selectively prevent sliding movement of the arm with respect to the cover and pivotal movement of the cover with respect to the box thereby retaining the cover in a desired one of a plurality of open positions.

5. The artist's kit as recited in claim 1, further comprising means disposed on said cover and receptive of an artist's canvas or the like for releasably mounting the canvas thereon adjacent to the inner surface of said cover when the cover is in an open position.

6. The artist's kit as recited in claim 5, wherein said means for releasably mounting the canvas comprises a top clamp having a first member configured to grip an edge of the canvas and at least one elongated second member affixed to said first member and having an elongated slot therethrough, means for slidably mounting said second member to said cover including a clamping member for clamping said second member to said cover and means affixed to said cover for supporting the canvas at a lower edge.

7. The artist's kit as recited in claim 6, wherein said means for supporting the canvas at a lower edge comprises means defining at least one aperture through said cover and a bottom support receivable in said aperture.

8. The artist's kit as recited in claim 6 whereas said means for supporting the canvas at a lower edge comprises a pair of spaced apart cleats affixed to a front edge portion of the cover and configured to receive the canvas at a lower edge.

9. The artist's kit as recited in claim 1, wherein the mounting surface comprises a tripod having a head plate and a threaded stud projecting upwardly therefrom and wherein said means for releasably clamping comprises means defining a mounting aperture in said base receptive of said stud and a wing nut engageable with said threaded stud for clamping said base to said head plate.

10. The artist's kit as recited in claim 3, further including at least one elongated leg member slidably mounted to said cover, said leg member positionable to enable an end thereof to bear against the mounting surface when the cover is in an open position.

11. The artist's kit as recited in claim 7, wherein said top clamp coacts with said bottom support to grip the canvas at opposite edges when said cover is in the closed position for releasably mounting the canvas adjacent to and spaced apart from the outer surface of said cover thereby protecting a wet canvas while transporting same.

12. An artist's kit comprising:

a. a rectangular box for holding artist's materials including a base and a front wall, a rear wall and side walls all vertically disposed with respect to said base, and further including a cover;

b. means mounting said cover to said box for pivotal movement between a closed position wherein said cover overlays the walls of said box and any one of a plurality of open positions; and c. means partly disposable within and without said box for releasably clamping said kit to an external mounting surface including means for biasing the base of said box against said mounting surface for effecting the clamping of said box to said mounting surface, wherein the releasable clamping means includes means defining at least two apertures in said base, a clamping brace positionable beneath the mounting surface, a pair of mounting members each having one end portion connectable to said clamping brace and the other end portion extendable through one of said apertures and wherein said biasing means is disposable within said box for acting on said other end of each mounting member for biasing said clamping brace against the underside of the mounting surface.

* * * * *